United States Patent [19]

Hirasuka

[11] 4,103,872

[45] Aug. 1, 1978

[54] OVERLOAD PROTECTION APPARATUS FOR HOISTING MACHINE

[75] Inventor: Koki Hirasuka, Hitachi, Japan

[73] Assignee: Hitachi, Ltd., Tokyo, Japan

[21] Appl. No.: 764,892

[22] Filed: Feb. 2, 1977

[30] Foreign Application Priority Data

Feb. 2, 1976 [JP] Japan ..... 51-9325

[51] Int. Cl.[2] ..... B66D 1/00

[52] U.S. Cl. ..... 254/168; 254/186 R

[58] Field of Search ..... 254/168, 167, 157, 159, 254/186 R, 187.1, 187.3, 187.4, 187.8; 74/12; 64/30 R

[56] References Cited

U.S. PATENT DOCUMENTS

| | | | |
|---|---|---|---|
| 360,544 | 9/1971 | Redelman | 64/30 R |
| 3,249,187 | 5/1966 | McDowall | 64/30 X |
| 3,727,887 | 4/1973 | Lytle | 254/168 |
| 3,741,527 | 6/1973 | Dahl | 254/168 |

FOREIGN PATENT DOCUMENTS

| | | | |
|---|---|---|---|
| 521,950 | 10/1953 | Belgium | 254/157 |

*Primary Examiner*—Drayton E. Hoffman
*Assistant Examiner*—Donald W. Underwood
*Attorney, Agent, or Firm*—Beall & Jeffery

[57] ABSTRACT

The disclosure relates to an overload protection apparatus for hoisting machine such as rope hoists or chain blocks. The apparatus has a slipping gear unit and a ratchet gear unit which are arranged on a shaft in a reduction gear assembly. The ratchet gear unit is adapted to be applied with a torque only when the hoisting machine is lowering the load, so as to impart an additional functional force to the slipping gear unit during a braking.

5 Claims, 5 Drawing Figures

OVERLOAD PROTECTION APPARATUS FOR HOISTING MACHINE

BACKGROUND OF THE INVENTION

The present invention relates to hoisting machines such as rope hoists or chain blocks and, more particularly, to such hoisting machines provided with an overload protection apparatus.

In general, for heavy duty hoisting machines, a maximum allowable weight that can be handled without danger is given as a rated load. However, since the operator does not always know the exact weight of the cargoes to be handled, weights exceeding the rated load are often applied to the hoisting machines, resulting in an overload operation. In order to avoid the danger of the overload operation, it is necessary to provide the hoisting machines with a suitable overload protection apparatus.

Hitherto, a variety of overload preventing apparatus have been proposed. One of them incorporates a mechanical balance adapted to produce a warning signal or to disconnect the hoist from the driving motor. In another overload protection apparatus, the load is sensed as the current through the driving motor during the hoisting. Thus, when an excessively large current is sensed, a warning is produced and the motor is stopped. Still another overload protection apparatus incorporates a mechanical torque limiter such as slip gears which slips for a torque exceeding a predetermined torque threby to stop the hoisting.

The first one has been found inconvenient in that it necessitates a number of parts and expensive equipments for an accurate weighing. In addition, this type of overload protection apparatus requires a troublesome step of hoisting up the load for weighing the load.

The second type of overload protection apparatus has been found also inconvenient in that it requires complicated controlling circuits, as well as troublesome works of adjustment and usual maintenance, although it can provide a considerably accurate overload protection operation.

The third type of overload protection apparatus can perform the required function relatively easily with a highly simplified structure. However, there is a fear that the load once hoisted may be lowered unitentionally. The third type of overload protection apparatus would be the most acceptable one, if it is free from the danger of the unitentional and uncontrolled lowering.

When one gear or wheel constituting the reduction gears is designed to rely upon a frictional force, such that the wheel can transmit a torque smaller than a predetermined one but slips for a larger torque, the reduction gears themselves act as the overload protection apparatus which prevents the hoisting of an excessive load. However, a problem takes place when a load which is slightly smaller than the load causing the slipping of the wheel is hoisted. Namely, the hoisting machines are subjected to a larger torque when they are operated to adjust the height or position of the hoisted load by so called "inching operation" than when the load is initially lifted from the ground. Thus, when the "inching operation" is made for a load which is scarecely born by the slipping wheel, the resultant increased torque would exceed the capacity of the slipping wheel to allow the later to slip resulting in the unintentional and uncontrolled lowering of the hoisted load.

Once the uncontrolled lowering takes place, the frictional resistance exerted by the slipping wheel is changed to a kinetic frictional force which is, of course, smaller than the static frictional force by which the load has been hoisted, so that the lowering of the load can no more be stopped.

This means that the overload protection apparatus which is designed as a safety device may undesirably incur a danger.

OBJECTS AND SUMMARY OF THE INVENTION

It is therefore an object of the invention to provide a hoisting machine provided with an overload protection apparatus which is improved to avoid the unitentional and uncontrolled lowering of the once hoisted load.

According to the invention, an overload protection apparatus for hoisting means is constituted by a slip gear unit and a ratchet gear unit which are arranged on a shaft in a reduction gear assembly opposing to each other, wherein the driving torque is transmitted to the ratchet gear unit only when the shaft is rotated in the direction of lowering of the load, so that an additional frictional force may be imparted to the slipping gear when a braking is applied.

These and other objects, as well as advantageous features of the invention, will become more clear from the following description of preferred embodiments taken in conjunction with the attached drawings in which:

DESCRIPTION OF THE PREFERRED EMBODIMENTS

Figure 1:
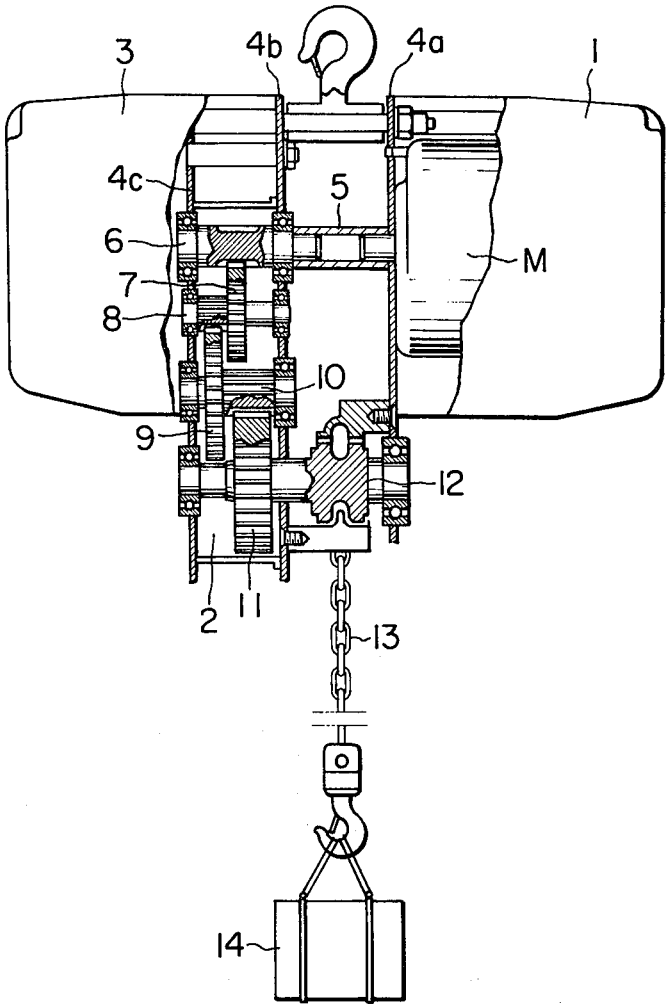
FIG. 1 is an illustration showing the whole structure of a chain block to which the overload protection apparatus of the invention is adapted to be applied, in which a reduction gear assembly is specifically exploded.

Referring at first to FIG. 1, a chain block to which the overload preventing device of the invention is applied is shown to have a driving part 1, a reduction part 2, a braking part 3, a sprocket 12 and a chain 13 for suspending a load 14.

An electric motor M is housed by the driving part 1 for transmitting a driving torque to the reduction part 2 through a coupling 5. The reduction part 2 is constituted by three pinions 6, 8 and 10 and three gears 7, 9 and 11. The motor M, coupling 5, pinions and gears of the reduction part 2 and the sprocket 12 are suitably supported by the frames *4a*, *4b* and *4c*.

As the electric motor M is energized, a braking force exerted by a brake in the braking part 3 is released so as to allow the motor M to drive the reduction part 2 through the coupling 5. The speed of rotation is reduced as the driving power is transmitted through the first pinion 6, the first gear 7, the second pinion 8, the second gear 9, the third pinion 10 and then the third gear 11 to the sprocket 12. Thus, the chain 13 meshing with the sprocket 12 is lifted and lowered at a reduced speed for lifting and lowering the load 14.

The above explanation is for showing the whole structure of a chain block to which the overload protection apparatus of the invention as will be detailed hereinafter is applied.

The overload protection apparatus of the invention is adapted to be incorporated in the reduction part 2 and, more specifically, can be theretically incorporated in the second or the following stages. A description will be made hereinafter for a specific illustrated embodiment in which the overload protection apparatus is incorporated in the second stage of the reduction part 2.

Figure 2:
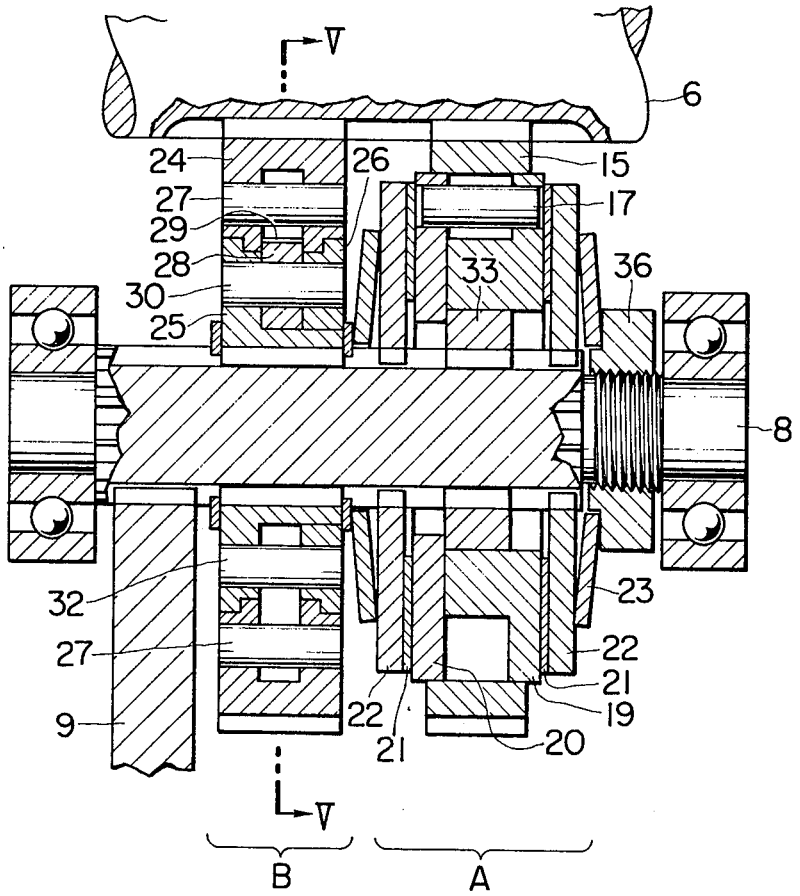
FIG. 2 is a sectional view of an essential part of an embodiment of the present invention.
Figure 3:
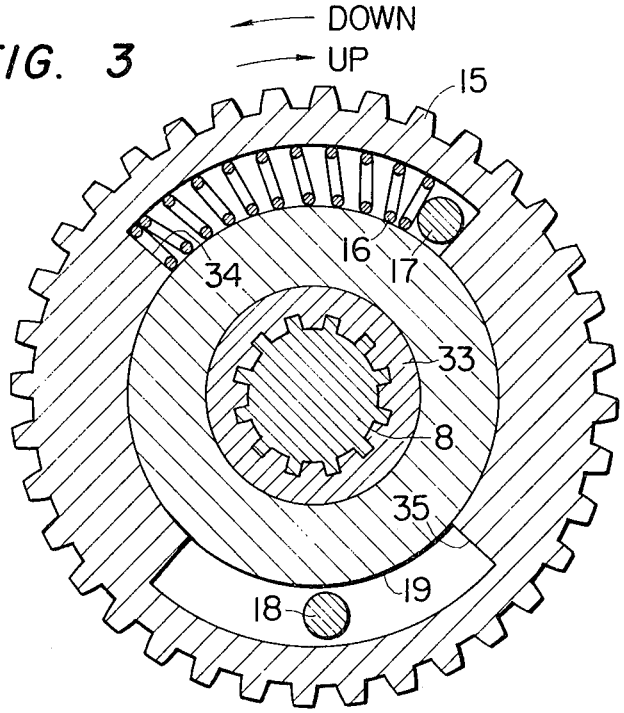
FIG. 3 is a cross-sectional view of a slipping gear unit which is an essential part of the overload protection means in accordance with the invention.
Figure 5:
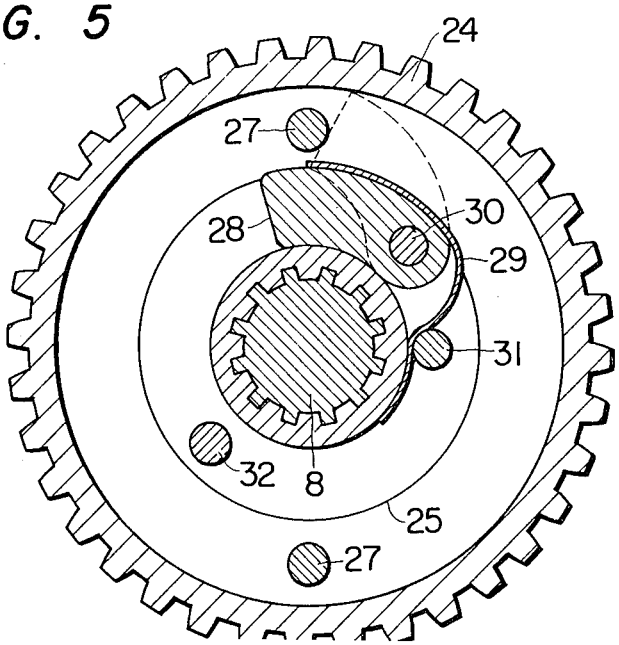
FIG. 5 is a sectional view taken along the line V—V of FIG. 2 and showing the construction of a ratchet gear unit which is also an essential part of the overload protection apparatus of the present invention.

As shown in FIG. 2, an overload protection apparatus in accordance with the present invention is comprised of an overload preventing mechanism arranged on the shaft of the second pinion 8, the mechanism including a slipping gear unit A and a ratchet gear unit B, the later being adapted to impart a braking torque during the lowering operation.

The slipping gear unit A and the ratchet gear unit B are disposed confronting the first pinion 6 constituting an input shaft and the second pinion 8 constituting an output shaft which are arrayed in parallel with each other.

Figure 4:
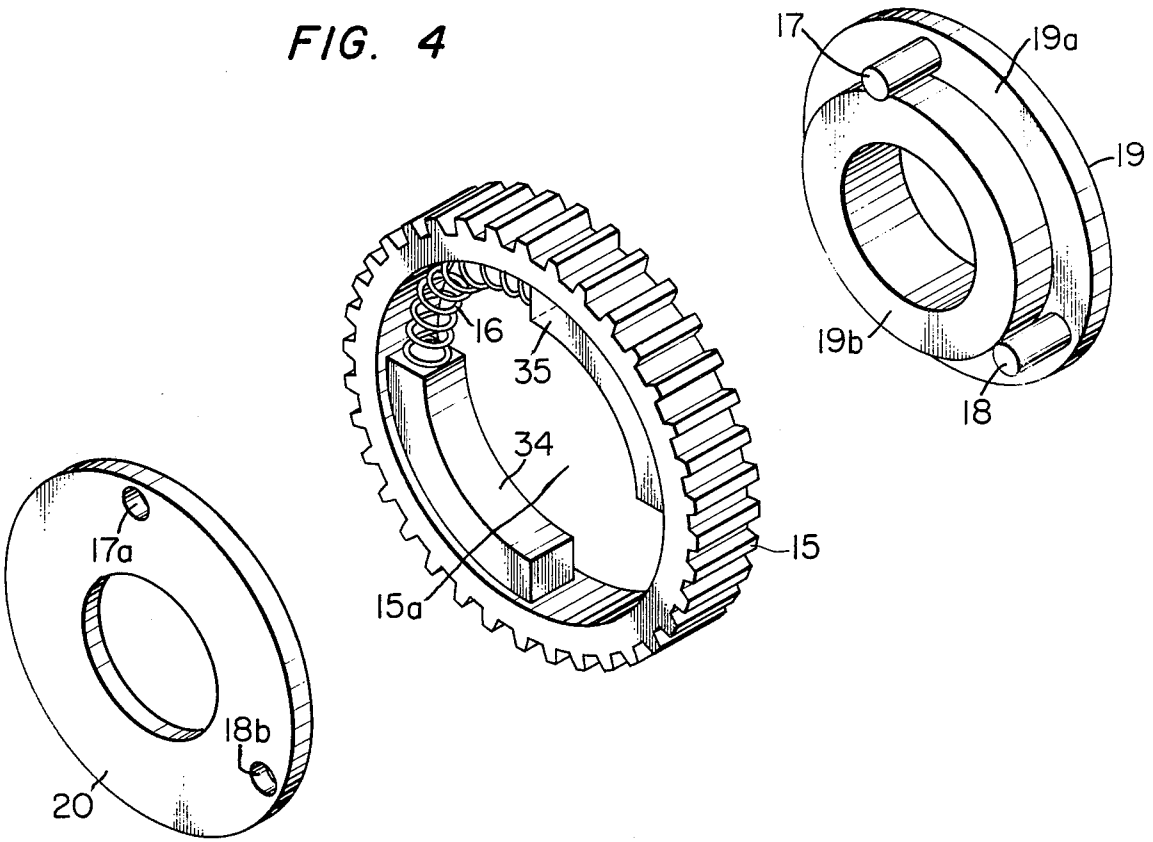
FIG. 4 is a perspective exploded view of parts constructing the slipping gear unit of FIG. 3.

Referring at first to the slipping gear unit A, a ring gear 15 for meshing with the first pinion 6 is carried by the second pinion 8. As will be seen from FIG. 4, the ring gear 15 is provided with a central bore 15*a* in which a pair of opposing protrusions 34 and 35 are provided.

The ring gear 15 is held in the position by a gear retaining plate 19 fixed around a ring-shaped bush 33 secured to the periphery of the second pinion 8, and by a ring-shaped gear retaining plate 20. The gear retaining plate 19 consists of a disk member 19*a* of a larger diameter and an axial projection or disk member 19*b* of a smaller diameter. Both disk members 19*a* and 19*b* are formed unitarily and concentrically with each other.

Another gear retaining plate 20 is provided with through holes 17*a* and 18*b*. The ring gear 15 is clamped between the retaining plates 19, 20 in such a manner that the both side surfaces of the protrusions 34, 35 are abutted by the larger disk members 19*a* of the plate 19 and by the plate 20, respectively, while pins 17 and 18 inserted into the retaining plate 19 are received by the through holes 17*a* and 18*b* in the retaining plate 20, respectively.

The gear 15 and the retaining plates 19, 20 are so dimensioned that the axial end surface of the smaller disk 19*b* comes in contact with the inner surface of the retaining plate 20, while the smaller disk 19*b* is fittingly received by the inner surface of the protrusions 34 and 35.

Consequently, two spaces housing respective ones of the pins 17 and 18 are defined by the ring gear 15 and the retaining plates 19 and 20. In the space accommodating the pin 17, a spring 16 is incorporated to act between the pin 17 and one circumferential end of the protrusion 34.

Two ring-shaped braking plates 22, 22 having linings 21 are provided for each one of the retaining plates 19 and 20. These braking plates 22, 22 are splined onto the second pinion 8. Disk springs 23 are provided at the axially outer sides of the braking plates 22, 22. One 23 of the disk springs is retained by a spring retainer 36.

Turning now to the ratchet gear unit, a ring gear 24 for meshing with the first pinion 6 is carried by the second pinion 8. The ring gear 24 has an internal boss 25 splined onto the second pinion 8. A ring-shaped plate 26 is fixed to the boss 25 by means of two pins 30, 32 so as to prevent the displacement of the ring gear 24 in the direction of a thrusting force.

Between the boss 25 and the plate 26, a claw 28 is urged inwardly by a leaf spring 29 about one pin 30 that pivotally mounts the claw 28, so as to rotate the claw 28 outwardly open at a certain speed of rotation by a centrifugal force, which is resisted by the biasing force exerted by the leaf spring 29.

The leaf spring 29 need not have a function of exactly adjusting the speed at which the claw 28 is opened but should exert a force to prevent the claw 28 from being opened by its own weight. Thus, a relatively weak or small leaf spring 29 will suffice. Pins 30 and 32 are provided for securing the boss 25 and the plate 26 to each other. The pin 30 is rotatably engaged by the claw 28, while the pin 31 serves to locate or position the leaf spring 29.

In operation, referring to the slipping gear unit A at first, a torque for lifting the load is transmitted from the first pinion 6 to the ring gear 15. Then, the ring gear 15 is rotated with its internal protrusion 34 compressing the spring 16 against the pin 17. As the internal protrusion 35 of the ring gear 15 comes in contact with the other pin 18, the torque is transmitted to the gear retaining plates 19 and 20. The torque thus transmitted is then imparted to the braking plates 22, through the linings 21, and then to the second pinion 8 to which the braking plates 22 are splined thereby to lift the load.

In this state, the compressed spring 16 is energized to rotate the pin 17 for lifting the load up.

The disk springs 23 are so adjusted as to allow the slipping between the linings 21 and the gear retaining plates 19, 20 when an excessive load is applied, i.e. when a torque exceeding a predetermined torque is caused in the slipping gear unit A, thereby to prevent the lifting of an excessively large load.

The unintentional and uncontrolled lowering of the once lifted load resulted by an inching operation of the hoisting machine is effectively prevented as will be shown below.

Assuming here that an impacting torque which is larger than that caused when the load leaves the ground is generated by the inching operation, after once lifting the load, a slip takes place between the linings 21 and the gear retaining plates 19 and 20 of the slipping gear unit A, allowing the rotation of the second pinion 8 while the first pinion 6 is remained unrotated. Thus, the boss 25 is allowed to rotate, since it is splined onto the second pinion 8, while the ring gear 24 meshing with the first pinion 6 is kept stationary.

When a lowering of the load is taking place, the claw 28 is always kept opened. Thus, as the slipping happens to occur, the claw 28 is opened to come in contact with the pin 27 fixed to the ring gear 24 to act unitarily with the ring gear 24 which is meshing with the stationary first pinion 6, so that the slipping is stopped.

As the load is delivered to the ground, after the gradual lowering with the claw 28 keeping the contact with the pin 27, the resultant release from the load causes the rotation of the second pinion 8 by the force of the compressed spring 16 of the slipping gear unit A in the counter direction for disengaging the claw 28 from the pin 27. It will be clear from the foregoing description that the claw 28 must be correctly disengaged from the pin 27 when the load is released, for otherwise an excessively large load would be hoisted when the hoist is started again. However, as explained above the disengagement of the claw 28 is surely performed when the load is landed.

As has been described, according to the invention, a ratchet gear unit is provided on the shaft supporting a slipping gear unit, the ratchet gear unit having a claw adapted to open only when it is rotated at a high speed to impart a torque to the ratchet gear unit, so as to impart an additional frictional torque to the slipping gear unit during the braking. In addition, the slipping gear unit is provided with a function of rotating by a certain angle the shaft on which the claw is mounted in the direction opposite to the direction of the lowering, so as to ensure the returning of the claw when the load is released safely to the ground.

It will be understood from the foregoing description that the hoisting of a load exceeding a rated load can fairly be avoided in the hoisting machine incorporating the overload protection apparatus of the present invention, and that the hoisting machines are rendered highly safe, since the unintentional and uncontrolled lowering or dropping of the once lifted load cannot take place unless a breaking of a shaft or a gear constituting the driving system occurs.

What is claimed is:

1. In an overload protection apparatus for hoisting machines having a driving part including an electric motor, an output, and a reduction part interconnecting said driving part and said output, with said reduction part having parallelly disposed input and output shafts, the improvement comprising: a slipping gear unit and a ratchet gear unit which are mounted drivingly connected between said input and said output shafts, said slipping gear unit and said ratchet gear unit respectively having outer ring gears engaging with said input shaft, said slipping gear unit having means to slip for torques exceeding a predetermined torque, said ratchet gear unit having ratchet means to engage its ring gear when said output shaft is rotated in a direction for lowering the load carried by said hoisting machine at a speed exceeding a predetermined speed, said slipping gear unit ring gear having inwardly extending protrusions, gear retaining plates for clamping said ring gear at its opposite sides and a spring acting between said protrusions and said plates for biasing said protrusions and said plates to one extreme position of limited relative lost motion and being compressed as said protrusions and said plates move to the opposite extreme position of the limited relative lost motion when transmitting torque between said input shaft and said output shaft.

2. An overload protection apparatus as claimed in claim 1, wherein said ratchet gear unit comprises said ring gear, a boss provided inside of said ring gear, a plate provided opposing to said boss, a claw provided between said boss and said plate, and second spring for biasing said claw.

3. An overload protection apparatus for a load hoist having a power source and a speed reduction unit drivingly connected with the power source, comprising: a rotary input member, a rotary output member, a torque responsive overload coupling drivingly connected between said input member and said output member for permitting relative rotation between said input member and said output member when the torque on said output member exceeds a fixed value to prevent overloading, speed responsive means to automatically drivingly engage said input member with said output member to transmit torque substantially higher than said fixed value when the speed of rotation of said output member exceeds a fixed value, said overload coupling including a first member positively interengaged with one of said input members and said output members and a second member frictionally engaged with the other of said input members and said output members, said first and second members being interconnected for limited relative rotational lost motion about the axis of rotation of said output member, and spring means between said first member and said second member for biasing said first and second members to one extreme position of the limited relative lost motion and being compressed as said first and second members move to the opposite extreme position of the limited relative lost motion when transmitting torque between said input member and said output member; said spring means storing energy upon transferring torque and releasing the energy when the load is released from the hoist to relatively rotate said second member and said first member from said other extreme position to said one extreme position and thereby assure disengagement of said speed responsive means.

4. The apparatus of claim 3, wherein said input member has a plurality of gear teeth around its periphery; said overload coupling and said speed responsive means have at least one ring gear drivingly interengaged with the gear teeth of said input member; and said overload coupling and said speed responsive means are each concentrically mounted around said output member and concentrically mounted with said at least one ring gear.

5. The apparatus of claim 4, wherein said speed responsive means includes a pawl rotatably mounted on said output member about an axis extending parallel to said output member and extending through said pawl at a distance spaced from its center of gravity, so that said pawl will tend to rotate outwardly in one direction about its axis by centrifugal force during rotation of said output member, spring means for biasing said pawl in the opposite direction with a force substantially equal to the centrifugal force generated by rotation of the output member at said fixed value of rotational speed, and abuttment means mounted on said at least one ring gear to be positively engaged by said pawl when said pawl is moved outwardly by centrifugal force against the bias of its spring means.

* * * * *